United States Patent [19]

Pollack

[11] Patent Number: 4,797,033

[45] Date of Patent: Jan. 10, 1989

[54] ANCHOR LINE-STABILIZED SYSTEM

[75] Inventor: Jack Pollack, Reseda, Calif.

[73] Assignee: Amtel, Inc., Providence, R.I.

[21] Appl. No.: 216,151

[22] Filed: Dec. 15, 1980

Related U.S. Application Data

[63] Continuation-in-part of Ser. No. 137,840, Apr. 7, 1980, abandoned.

[51] Int. Cl.[4] ..... E02B 17/00

[52] U.S. Cl. ..... 405/202; 33/366; 405/224

[58] Field of Search ..... 405/195, 202, 211, 224; 33/365, 366

[56] References Cited

U.S. PATENT DOCUMENTS

| | | | |
|---|---|---|---|
| 2,986,888 | 6/1961 | Borrmann et al. | 405/224 |
| 3,010,214 | 11/1961 | Postlewaite | 33/366 X |
| 3,167,049 | 1/1965 | Foster | 33/366 X |
| 3,461,828 | 8/1969 | Bielstein | 405/224 |
| 3,563,043 | 2/1971 | Nelson | 405/202 |
| 4,109,479 | 8/1978 | Godeau et al. | 405/224 |

OTHER PUBLICATIONS

Myers et al, Eds., Handbook of Ocean and Underwater Engineering, pp. 4–44 to 4–47 and 9–92 to 9–95 Mc--Graw Hill (1969).

*Primary Examiner*—David H. Corbin

*Attorney, Agent, or Firm*—Freilich, Hornbaker, Rosen & Fernandez

[57] ABSTRACT

An offshore system of the articulated tower type is provided, which utilizes chain devices extending in different directions from the upper portion of the tower to the seabed to help maintain the tower in a largely vertical orientation. In one system wherein the tower must be held close to the vertical orientation, as where the system is used for drilling underwater hydrocarbon wells, an inclinometer is utilized to measure small angles of tilting of the tower, to operate one or more winches that pull on the chain devices. The chain devices can be in the form of heavy chains extending in loose curves. In another system, the chain devices are lines of highly stretchable material such as nylon, and which may be nearly neutrally buoyant, and with the lines extending in almost straight lines between the tower and seabed.

4 Claims, 2 Drawing Sheets

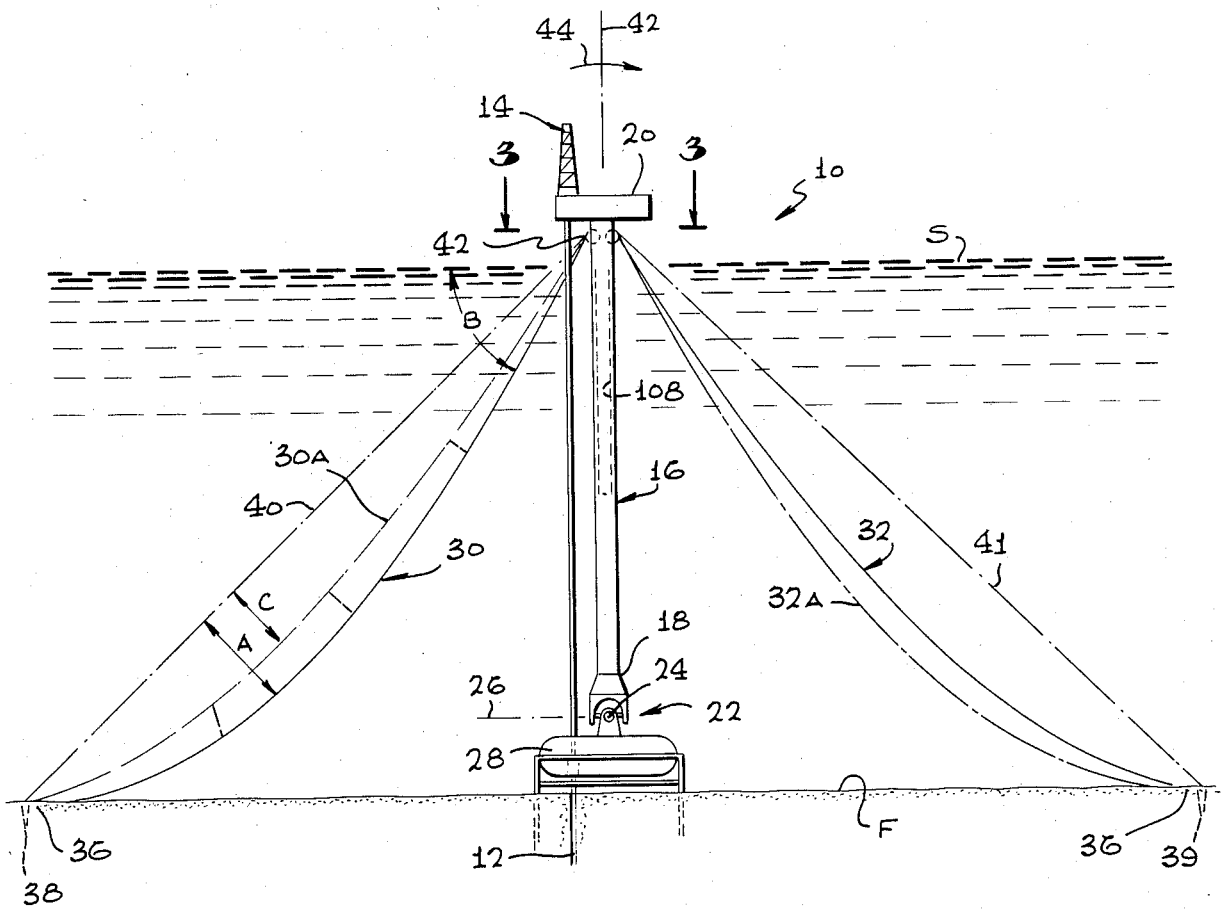
FIG. 1
FIG. 5
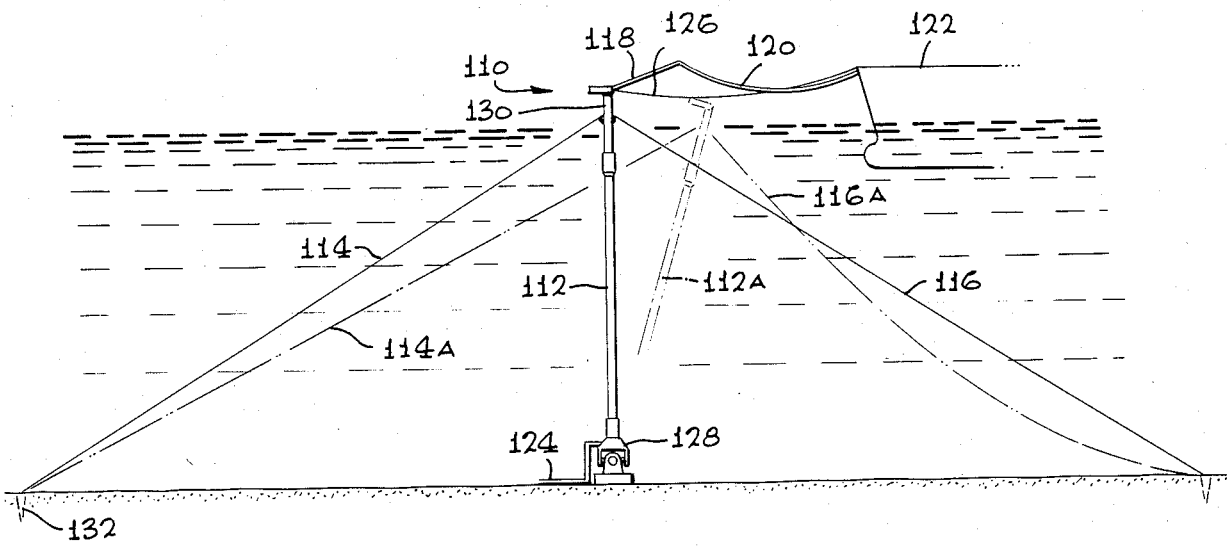

FIG. 3
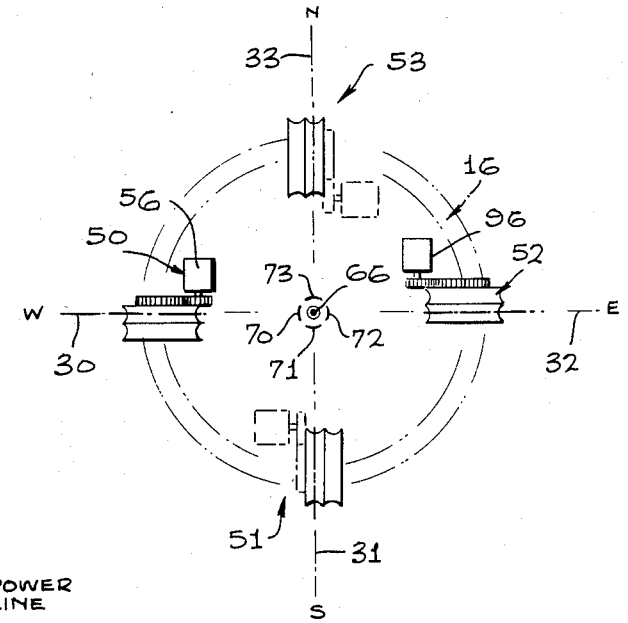
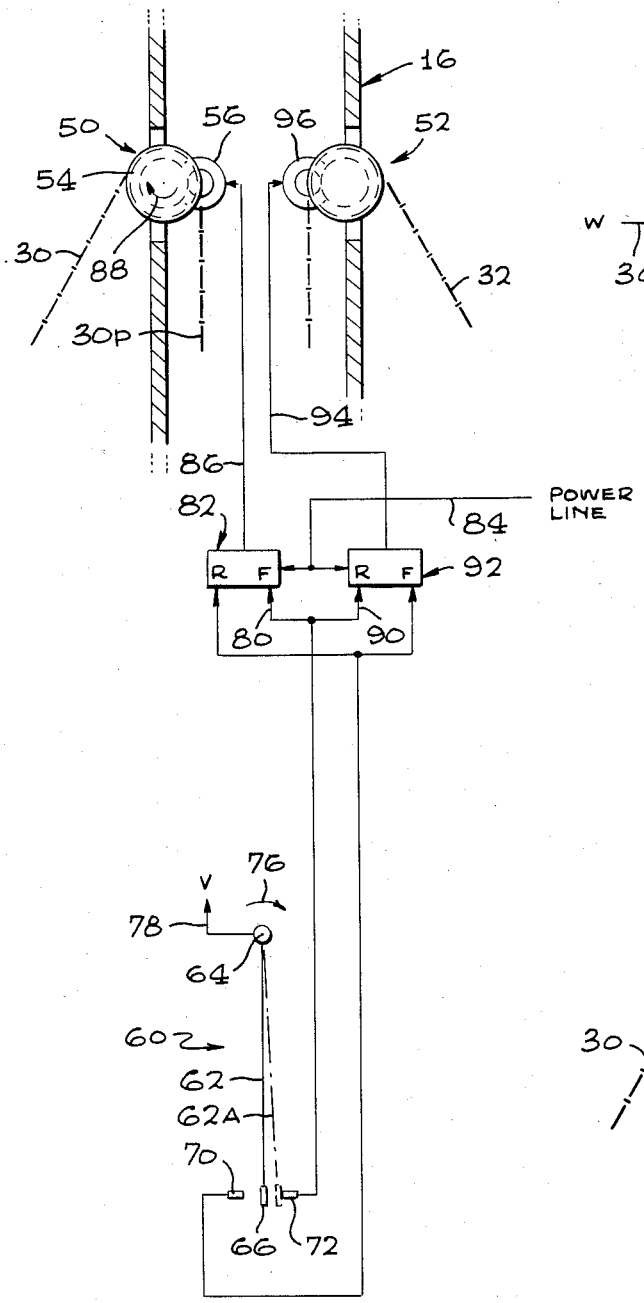
FIG. 2
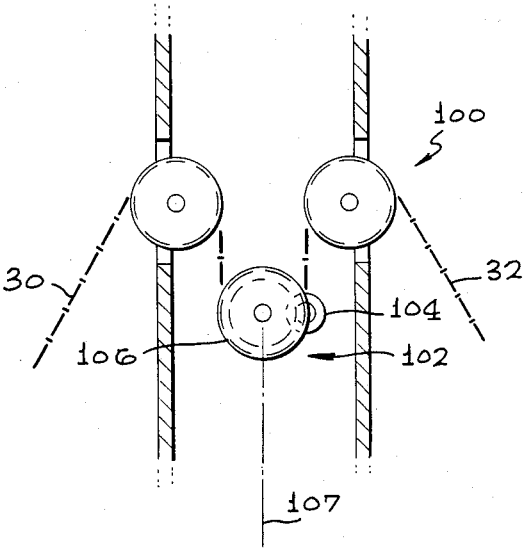
FIG. 4

ANCHOR LINE-STABILIZED SYSTEM

BACKGROUND OF THE INVENTION

Offshore installations which utilize articulated towers, can be utilized in a variety of applications. In the mooring of ships, the tower is allowed to pivot by a wide angle such as 20° from the vertical, to accommodate motions of the ship, but the tower is biased towards the vertical position. In the drilling of undersea wells the tower can serve as a fixed platform, but means must be provided to prevent large pivoting of the tower away from an initial vertical position.

An articulated tower that is allowed to pivot by a wide angle, can be biased towards the vertical by the use of a buoy formed along the upper portion of the tower. An articulated tower utilized in an application where very little pivoting is allowable, can be held in its vertical orientation by taut guy wires extending in different directions from the top of the tower to the seabed. In each of these systems, the above techniques for urging the tower towards the vertical makes it "stiff" against pivoting, which can result in large stresses on the structure. The forces that tend to move the tower include long term moderate forces resulting from currents and winds, and large but short duration forces caused by waves. A tower which is stiff against pivoting will have a relatively short natural period of oscillation about its pivot point, and if this period is low enough to be close to the period of waves then the tower tends to be moved considerably by the waves. For articulated towers utilized in shallow water with large buoys, the tower tends to have a large stiffness, or short period of oscillation, that may match that of the waves, so that the tower is affected to a large extent by waves. Towers in relatively shallow water that are held against large pivoting by taut guy wires, also have a high stiffness that produces a relatively short period of natural oscillation. Offshore articulated tower systems which could be biased towards their vertical orientation in a manner that minimized the stiffness of tower pivoting to maintain a relatively long natural period of oscillation, would enable articulated towers to be utilized in relatively shallow water without subjecting them to high forces from waves.

SUMMARY OF THE INVENTION

In accordance with one embodiment of the invention, an offshore articulated tower system is provided, wherein the tower is maintained against pivoting far from an initial substantially vertical orientation without greatly increasing the stiffness of pivoting of the tower. At least three chain devices or lines are provided, which have upper ends coupled to an upper portion of the tower and lower ends anchored to the sea at locations spaced about the tower. Inclinometer means are utilized to sense tilting of the tower, and to operate winch means that pull on at least one chain device extending largely opposite to the direction of tilting, to tend to restore the tower to its initial orientation. The chain devices can be highly negatively buoyant members such as steel chains, and can extend in loose catenary curves from the upper portion of the tower to the seabed, so the winch means can reduce the curvature of the catenary chain without pulling it taut into an almost straight line. The looseness of the chain allows it to "give" so that the tower can pivot a small amount under the forces of waves, to thereby maintain a relatively long period of natural frequency of oscillation of the tower.

In another embodiment of the invention, an articulated tower system wherein the tower can pivot by a large angle, is biased towards its initial position by a group of lines of highly stretchable material such as nylon. The elastic lines tend to restore the tower to its vertical orientation, but can easily stretch to accommodate short term large forces on the tower applied by waves, to thereby avoid a large reduction in the natural frequency of oscillation of the tower when utilized in relatively shallow water.

The novel features of the invention are set forth with particularity in the appended claims. The invention will best be understood from the following description when read in conjunction with the accompanying drawings.

BRIEF DESCRIPTION OF THE DRAWINGS

FIG. 1 is a side elevation view of an offshore articulated tower system constructed in accordance with one embodiment of the present invention.

FIG. 2 is a partial side and partial block diagram view of the system of FIG. 1.

FIG. 3 is a partial view taken on the line 3—3 of FIG. 1.

FIG. 4 is a partial side view of a winch arrangement modified from that of FIG. 2.

FIG. 5 is a side elevation view of an offshore articulated tower system constructed in accordance with another embodiment of the invention.

DESCRIPTION OF THE PREFERRED EMBODIMENTS

FIG. 1 illustrates an offshore articulated tower system 10 which can be utilized in the drilling of an undersea well 12 by a drilling rig 14 located at the upper end of an articulated tower 16. The tower 16 is a tall but thin structure that has a lower end 18 near the level of the sea floor F and an upper end 20 lying above the sea surface S. The lower end 18 of the tower is pivotally connected to the sea floor through a tilt joint 22 that permits the tower to tilt about two horizontal axes 24, 26 on a base 28 that is mounted on the sea floor. The upper end 20 of this tower is in the form of a working platform that lies totally above the sea surface and that carries the drilling rig 14.

The tower 16 may be urged to tilt under the influence of current, winds, and waves. Such forces are opposed by the use of a group of lines, or chain devices, such as 30, 32 that have upper ends coupled to an upper portion of the tower, and that have lower ends 36 anchored to the sea floor by anchors 38, 39. Each of the chain devices 30 in this embodiment of the invention, are in the form of heavy steel chains, and are long enough to extend in loose catenary curves. For example, the chain 30 extends in a loose curve wherein the maximum distance A between an imaginary straight line 40 extending between the upper end 42 of a chain where it is coupled to the tower and the anchor point 38 is much more than 5% of the total length of the imaginary line 40, and in fact, is more than 10% as great. If it were satisfactory for the tower 16 to pivot away from the vertical by a large angle such as 20°, then the heavy chains could have their upper ends fixed to the tower and would serve to bias the tower towards its quiescent vertical position. However, where only a small angle of tilt of less than 5°, of the tower axis 42 from its initial substantially vertical orientation,is permissible, this can be accomplished by pulling on selected ones of the chains.

Tilting of the tower axis 42 by even a small amount away from an initial desired position, which is usually a vertical position, can be detected by a relatively simple inclinometer apparatus. When such tilting is detected, winches in the tower can be operated to pull selected ones of the chains such as 30 or 32. For example, when the tower tilts in a direction indicated by arrow 44, a winch attached to the upper end of chain 30 can pull this chain so that it is shortened and extends along a somewhat tighter, but still loose catenary curve 30A. The maximum distance C of the pulled chain 30A from the imaginary straight line 40 is more than 5% of the length of the straight line and of the chain, when only moderate tilting forces are applied. This tightening of the chain increases the tension applied by the chain to the tower, to urge the tower to tilt in a direction opposite to the arrow 44 so as to restore the tower to its original orientation If the chain 30 had very little weight, then very little tension could be applied to it until it extended almost straight along the imaginary line 40. However, the great weight of the chain 30 of a plurality of tons, permits it to apply a large tension even though it extends in a loose curve, and with the tension increasing as the curve is straightened somewhat even though it remains loose. The upper end of the chain 30 extends at an angle B of about 55° from the horizontal and the anchor location 38 at the lower end of the chain is spaced from the lower end of the tower by more than 50% of the height of the sea thereat. When the chain is pulled to the position 30A, this angle decreases so in a horizontal direction. In addition, the tension in the chain increases as a lower portion of the chain that initially rests on the sea floor is lifted off the sea floor and part of its weight adds to the tension. The restoring force is further enhanced by operating a winch to loosen the opposite chain 32 so that it extends in a looser curve at 32A to apply less force to the tower tending to tilt it in the direction of the arrow 44.

FIG. 2 shows two of the winches 50, 52 that can be operated to pull or release selected chains in accordance with tilting of the tower. Each of the winches such as 50 includes a pulley 54 about which the chain is wrapped, and a motor 56 connected through a gear train to the pulley to turn it in a direction to pull on or release the chain. A portion of the chain at 30P within the tower may simply drop into a chain locker, or may be wound upon a drum coupled to the motor 56 to prevent slipping of the chain on the pulley.

Tilting of the tower can be sensed by an inclinometer 60 which includes a damped wire or rod 62 that hangs from a pivot point 64 within the tower. The lower end of the wire 62 carries a contact element 66 which can swing against any one of four electrodes such as 70 and 72. When the tower tilts in the direction indicated by arrow 76, the wire 62 will tilt to the position 62 A and the contact element 66 will touch the electrode 72. Current will then flow from a wire 78 connected to a voltage source, through the wire 62 to the electrode 72, and from there to a forward input 80 of a switch 82. The signal on input 80 causes the switch 82 to connect current from a power line 84 through the switch and through a line 86 to the motor 56 to turn the motor in the direction indicated by arrow 88 to pull on the chain device 30. Pulling on the chain device 30 urges the tower to tilt in a direction opposite to the arrow 76 to restore it to its initial orientation. At the same time, the signal delivered to the input 80 of the switch 82 is also delivered to the reverse input 90 of another switch 92, to cause the switch 92 to deliver current of a reverse polarity over a line 94 to the motor 96 to operate the other winch 52 in a direction to release, or pay out, the opposite chain device 32. If the tower tends to tilt in the opposite direction so that contact element 66 engages electrode 70, then a signal from electrode 70 will be delivered to other inputs of the switches 82, 92, to cause them to deliver currents of opposite polarities to the motors 56, 96 so as to cause the motors to turn in the reverse direction to release chain device 30 and pull in the other chain device 32.

FIG. 3 shows that the system actually includes four winches 50, 51, 52, and 53 that can pull or release four corresponding chain devices 30–33 extending in four different compass directions from the axis of the tower. Also, the contact element 66 of the inclinometer can contact any one or an adjacent pair of four electrodes 70–73 to pull and release any one of the four chain devices. The two other electrodes 71 and 73 are connected to corresponding switches that operate motors of the winches 51–53. It should be noted that a variety of devices can be used to sense tower tilting. For example, sonar beacons can be used to measure the distance between points on the tower and on the seabed, to detect tower tilting.

Instead of using a separated winch for each chain device, it is possible to use one winch to simultaneously pull in one chain device and release another. FIG. 4 shows a system 100 wherein the two opposite chain devices 30, 32 that extend in opposite compass directions from the tower are connected together to extend continuously through the column. A single winch 102 having a motor 104, can pull in one chain device 30 and simultaneously pay out the other 32. This arrangement minimizes the power to be applied by the motor 104, since the tension in one chain device 32 reduces the force that has to be applied to the sheave 106 of the winch in pulling in the other chain device 30. In addition, there is less possibility of slippage of the chain devices on the winch sheave, and a special chain storage locker is not required. The tensions in both chain devices can be increased or decreased (to alter the "stiffness" of the system), or the tension in just one chain device can be adjusted, by mounting the winch sheave 106 so it can be moved up or down along the line 107.

The loose chain devices such as 30 of FIG. 1, are only loosely coupled to the tower, in that each chain device applies a biasing to the tower tending to pivot it but the tower can pivot a limited amount without substantially affecting the amount of sideward force applied by any of the chain devices. As a result, the stiffness of the tower and its corresponding natural period of oscillation about the tilt axes 24, 26 is reduced by perhaps half by the chains. If steel guy wires were utilized which extended along substantially straight lines such as the imaginary line 40 from the tower to the seafloor, then the amount of restoring force applied by each guy wire would greatly increase when the tower pivoted a small amount, so that the tower's natural period of oscillation would be at least an order of magnitude less than it would be in the absence of the guy wires. The loose chains 30 avoid this disadvantage.

An "unstiff" tower, or one with a long natural period of oscillation, particularly in the case of towers utilized in shallow waters where the small length of the tower results in a short natural period, is useful in avoiding large forces on the tower. As mentioned above, the principal forces tending to move the tower are wind, currents, and waves. Both winds and currents are typically of substantially constant characteristics, in that they tend to continue in one direction for a long period of time such as hours. Waves constitute short duration forces, in that the average period of larger waves encountered in seas is between about 9 and 15 seconds, or about 12 seconds. A tower of about 300 feet length, which carries most of its buoyancy near its upper end, near the sea surface, can have a natural period such as 60 seconds (obviously the exact period depends upon the particular length and buoyancy distribution). The use of taut guy wires to prevent pivoting of such a tower, would lower its natural period to perhaps one-tenth, which would be less than or close to the period of the waves, so that the guy wires would have to repeatedly apply large forces to prevent substantial pivoting of the tower. Such taut guy wires and the connections made to them would have to be of great strength to avoid damage such as through fatigue failure. In the present invention, the natural period of the tower is not reduced to a low level by taut guy wires, but instead is maintained at close to one half the natural period that would exist in the absence of the chain devices, by the use of loose chain devices.

In one test analysis, a tower lying in about 400 feet of water and which was hollow along its upper half was analyzed as having a natural period of about 80 seconds without chains and about 40 seconds with loose steel chains. The 40 second period is more than twice the period of about 15 seconds of large long period waves. It is estimated that taut guy wires would reduce the natural period to about four to eight seconds, which would result in a substantially rigid column that would require extremely strong guy wire devices.

The use of the chain devices to counteract long-term forces applied by winds and currents, enables the upper portion of the buoy to avoid large buoyancy chambers, so it can be thin and only small forces are applied to it by the waves (and by currents). It may be noted that the tower 16 does include a buoyancy chamber 108 to maintain it in tension along its length and to apply a constant upward force to the tilt joint 22, but very large buoyancy chambers are not required to keep the tower in its vertical orientation since the chain devices perform this function. Thus, by utilizing loose chain devices, applicant avoids lowering the natural period of the tower to a period close to that of the waves, to thereby avoid the application of large wave forces to the tower, and yet the chain devices in combination with the winches serve to counteract long term forces of the winds and currents to maintain the tower at a substantially vertical orientation. It may be noted that the chain devices could be operated to help counteract even wave forces, especially where the magnitude of succeeding waves is predictable so that the chain devices can be operated to anticipate them.

Instead of utilizing heavy chain devices such as steel chains, it is possible to utilize relatively light weight but highly elastic lines such as those formed of a highly elastic nylon which can elastically stretch by about 12% of its length. Such lines can be utilized in place of the devices such as 30 and 32 in FIG. 1, and can be utilized by having them extend substantially tautly, or in a substantially straight line. The stretchable lines or chain devices can extend along the lines shown at 40 and 41 in FIG. 1, between the upper portion of the tower and anchoring devices at 38 and 39. When the tower begins to tilt in one direction, the winches can be operated to pull on one of the stretchable lines such as 40 and release an opposite stretchable line such as 41, to bias the tower back towards the vertical. The stretchable lines can extend substantially straight despite only the low tension in them, because the lines can be formed of material such as nylon which has a specific gravity close to that of water so that the lines are almost neutrally buoyant in water. This is because most plastics have a specific gravity of between about 1.0 and about 1.5. This can be contrasted with chain devices formed of iron or steel links, where the iron or steel has a specific gravity of about 7.9. Such chains have an elasticity of less than one per cent, and there will be breakage or permanent deformation if the length of the chain is increased by a small percentage of its length which is less than one percent of its length, from a condition of slight tension. Elastic lines which can stretch by at least 5% of their length can be utilized in place of such heavy chains. The fact that the substantially taut line is highly elastic, means that the tower can pivot by a small amount under the influence of waves, without greatly increasing the force applied to the tower by the stretchable lines, so that the lines do not decrease the natural frequency of oscillation of the system to a level approaching that of the waves. The larger and long term forces applied to the tower by winds and currents, are counteracted by operating the winches to pull on selected lines so as to increase the tension of the lines to prevent appreciable tower tilting in much the same way as for the loose and heavy chains.

In another application for articulated towers, to moor a vessel while transferring fluid between an undersea pipeline and the vessel, the tower can be allowed to pivot by a large angle such as over 20° from the vertical. In that case, the chain devices such as the loose but heavy chains shown at 30 and 32 in FIG. 1 (or steel cables) can be utilized, or stretchable lines can be utilized, but without the need for a tower tilt sensing device or winches. This is because tilting of the tower by a large angle will automatically cause the tower to pull on the chain devices (whether loose but heavy chains or cables, or lightweight elastic lines) extending away from the direction of tilting while releasing chain devices extending in the direction of tilting. In this case, the use of chain devices can restore an articulated tower towards its vertical orientation without the need for large buoyancy chambers along the tower that greatly reduce the natural frequency of the tower as well as add considerable expense.

FIG. 5 illustrates an installation 110 wherein a tower 112 is utilized in conjunction with highly elastic chain devices or lines 114, 116 that can restore the tower to its vertical orientation shown at 112. The tower has a boom 118 at its top which supports a hose 120 that extends from a tower to a vessel 122 such as a large tanker. Oil flowing through an undersea pipeline 124 passes up along the tower and through the hose 120 to the vessel. The vessel is moored by a hawser 126 attached to the boom, and the tower is allowed to tilt, as to the position shown at 112A to accommodate movements of the vessel as well as environmental loads acting on the vessel.

The tower is pivotally connected by a tilt joint 128 to the sea floor to accommodate such motion. The lines 114, 116 are formed of a highly elastic material such as nylon which can elastically stretch by more than 5% of its length, and in fact by more than 10% of its length, and which is substantially neutral buoyant in water in that it has a specific gravity of less than 2 and preferably less than 1.5. The lines initially extend in substantially straight lines between an upper portion 130 of the tower and an anchor location such as 132 at the seabed. The tower 112 is actually held by four elastic lines which extend in four different compass directions from the upper portion of the tower. The upper ends of the lines are fastened to the tower so that they are under only slight tension when there are no sideward forces on the tower due to winds, current, or waves.

When the tower tilts, as towards the orientation 112A, the line 114 becomes progressively more stretched, and in the orientation 114A it is highly stretched. The stretching of the line increases its tension, to apply a progressively greater force on the tower tending to restore it to its vertical orientation. At the same time, any initial tension in an opposite line such as 116 is reduced when the line moves to the position 116A. In order to permit large angles of tilting of the tower such as more than 20°, each of the elastic lines such as 114 must have a length much greater than the height of the tower 112, so that the length of the line 114 is not increased by more than the elastic limit of the line during such tilting. For example, a line 114 having a length of about three times the height of the tower 112 or of the depth of the sea, stretches about 10% when the tower tilts about 20°. Accordingly, the length of the stretchable line 114 will normally be at least about two or three times the depth of the sea to accommodate large tower tilting.

Thus, the invention provides an articulated tower system which utilizes anchor lines extending in different compass directions from the upper portion of the tower to the seabed, to help stabilize the tower. In one system wherein very little tower tilting is permissible, an inclinometer means is utilized to sense tilting of the tower, even when tilting of the tower is only imminent, to operate winch means that pull on selected chain devices or lines to prevent more than a small angle of tower tilting. In another type of installation, considerable tower tilting is permissible, and quiescent anchor lines can be utilized whose upper ends are fixed to the tower without being pulled by winch means or the like during tower tilting. The anchor lines are utilized to restore the tower to a vertical orientation, without greatly decreasing the natural period of the tower. The chain devices can be heavy chains formed of iron or steel, which extend in loose catenary curves, or can be formed of highly stretchable and substantially neutrally buoyant materials such as a polymer.

Although particular embodiments of the invention have been described and illustrated herein, it is recognized that modifications and variations may readily occur to those skilled in the art and consequently, it is intended that the claims be interpreted to cover such modifications and equivalents.

I claim:

1. An offshore system comprising:

a tower having a lower end lying nearer the sea floor than the sea surface, said tower having an upper end portion lying at a height at least near the sea surface, said tower being tiltable away from a vertical orientation;

a plurality of chain devices having upper ends extending at downward inclines from the upper end portion of the tower and lower ends anchored to the sea floor at locations that are spaced about the lower end of the tower and that are spaced from the lower end of the tower by over 50% of the height of the sea above the sea floor;

means for sensing tilting of said tower;

which means on said tower and coupled to the upper ends of said chain means for selectively pulling on said chain means; and means responsive to said sensing means for operating said winch means to pull on at least one chain means which lies largely opposite the direction of tower tilting;

each of said chain devices extending in a loose catenary curve wherein the maximum deviation (A) of the chain device from an imaginary straight line extending between the upper end of the chain and the anchor location of the lower end of the chain, is more than 5% of the length of the chain device.

2. The system described in claim 1 wherein:

at least two of said chain means extend in substantially opposite compass directions from said tower and have upper ends connected together, and said winch means includes a winch that moves the connected portion of the two chain means simultaneously to enable tension in the chain means which is being payed out to at least partially offset the tension in the chain means being pulled in.

3. The offshore system described in claim 1 wherein:

the maximum deviation of each of said chain devices from one of said imaginary straight lines is at least about 10% of the length of the chain device.

4. A method for maintaining in a largely vertical orientation, a tiltable tower that has a lower end connected to the sea floor and an upper end extending at least about as high as the sea surface, comprising:

sensing the inclination of said tower; and pulling on the upper end of at least one of a selected group of chain devices that extend from an upper portion of the tower to the sea floor and whose lower ends are anchored to the sea floor at locations widely spaced from the lower end of the tower and from each other, including pulling on a chain device whose lower end is spaced from the tower in a direction largely opposite to the direction of tower tilting and which extends in a loose curve which has a maximum spacing, from an imaginary straight line connecting opposite ends of the chain device, by more than 5% of the total length of the chain device, to raise the average height of the chain device while still leaving it in a loose curve.

* * * * *